US012201199B2

(12) United States Patent
Hermanson et al.

(10) Patent No.: US 12,201,199 B2
(45) Date of Patent: Jan. 21, 2025

(54) BOWED POLE

(71) Applicant: John Hermanson, Saint Paul, MN (US)

(72) Inventors: John Hermanson, Saint Paul, MN (US); Todd R. Boss, Minneapolis, MN (US)

(73) Assignee: John Hermanson, Saint Paul, MN (US)

( * ) Notice: Subject to any disclaimer, the term of this patent is extended or adjusted under 35 U.S.C. 154(b) by 117 days.

(21) Appl. No.: 17/624,242

(22) PCT Filed: Jul. 1, 2020

(86) PCT No.: PCT/US2020/040439
§ 371 (c)(1),
(2) Date: Dec. 30, 2021

(87) PCT Pub. No.: WO2021/003230
PCT Pub. Date: Jan. 7, 2021

(65) Prior Publication Data

US 2022/0346509 A1 Nov. 3, 2022

Related U.S. Application Data

(60) Provisional application No. 62/869,701, filed on Jul. 2, 2019.

(51) Int. Cl.

| | |
|---|---|
| ***A45B 7/00*** | (2006.01) |
| ***A45B 9/02*** | (2006.01) |
| ***A45B 9/04*** | (2006.01) |
| *A45B 9/00* | (2006.01) |

(52) U.S. Cl.
CPC ..... *A45B 7/005* (2013.01); *A45B 9/02* (2013.01); *A45B 9/04* (2013.01); *A45B 2009/007* (2013.01)

(58) Field of Classification Search
CPC ..... A45B 7/005; A45B 2009/005
See application file for complete search history.

(56) References Cited

U.S. PATENT DOCUMENTS

| | | | | |
|---|---|---|---|---|
| 2,568,654 | A * | 9/1951 | Neptune | A61H 3/02 135/69 |
| 5,301,704 | A | 4/1994 | Brown | |
| 5,392,801 | A | 2/1995 | Hannoosh et al. | |
| 5,904,167 | A | 5/1999 | Moye | |
| 5,996,602 | A | 12/1999 | Cato, III | |

(Continued)

FOREIGN PATENT DOCUMENTS

| | | |
|---|---|---|
| CN | 203598086 U | 5/2014 |
| CN | 204811160 U | 12/2015 |

OTHER PUBLICATIONS

International Search Report and Written Opinion pertaining to PCT/US2020/040439, mailed Sep. 24, 2020.

*Primary Examiner* — Noah Chandler Hawk
(74) *Attorney, Agent, or Firm* — GRUMBLES LAW PLLC; Brittany Haanan

(57) ABSTRACT

A curved or bowed pole having at least a top portion and a bottom portion is disclosed that is structured and configured to aid persons in motion under their own power. The disclosed pole can be modular and include at least two or more sections that can attach or detach to each other. Additionally, a curved or bowed pole is disclosed that can include a paddle, a ski shoe, or an adjustable hook foot attached to its bottom portion or a cross handle attached to its top portion.

13 Claims, 8 Drawing Sheets

(56) References Cited

U.S. PATENT DOCUMENTS

| | | | | |
|---|---|---|---|---|
| 6,131,592 | A | 10/2000 | Panizza | |
| 7,647,937 | B2 | 1/2010 | Gordon | |
| 7,823,599 | B2 | 11/2010 | Thibodeau et al. | |
| 8,276,943 | B2 | 10/2012 | Best et al. | |
| 8,926,384 | B1 * | 1/2015 | Alphin | B63H 16/04 440/101 |
| 9,364,057 | B2 * | 6/2016 | Halonen | A45B 7/005 |
| 10,098,424 | B1 * | 10/2018 | Husted | A45B 9/00 |
| 10,676,169 | B2 * | 6/2020 | Charles | A63C 17/26 |
| 2003/0227167 | A1 * | 12/2003 | Redor | A63C 11/22 280/819 |
| 2004/0069337 | A1 | 4/2004 | Battiston | |
| 2004/0107981 | A1 | 6/2004 | Smith | |
| 2004/0250845 | A1 * | 12/2004 | Rudin | A45B 7/005 135/77 |
| 2011/0073145 | A1 | 3/2011 | Goldberg et al. | |
| 2012/0031447 | A1 * | 2/2012 | Lai | A45B 3/00 135/77 |
| 2012/0288326 | A1 | 11/2012 | Lah | |
| 2012/0322632 | A1 * | 12/2012 | Kezer | A63B 21/4035 482/121 |
| 2016/0058140 | A1 * | 3/2016 | Woodall | A45B 9/04 135/82 |
| 2016/0228759 | A1 * | 8/2016 | Henrie | A63C 11/22 |
| 2017/0290729 | A1 * | 10/2017 | Saluja | A61H 3/0288 |
| 2018/0055163 | A1 * | 3/2018 | Rudin | A45B 7/005 |
| 2018/0333322 | A1 * | 11/2018 | Clausen | A61H 3/0288 |
| 2023/0200505 | A1 * | 6/2023 | Rahmanfard | A45B 9/02 135/65 |

* cited by examiner

BOWED POLE

RELATED APPLICATIONS

This application claims the benefit of U. S. Provisional Patent Application Ser. No. 62/869,700, that was filed Jul. 2, 2019, entitled "BOWED POLE" which incorporated herein by reference in its entirety.

FIELD OF THE DISCLOSURE

This disclosure relates to devices for aiding persons in motion under their own power, and more particularly, to handheld poles for supporting and propelling said persons.

BACKGROUND OF THE INVENTION

The use of handheld poles by persons propelling themselves in motion is known. For example, skiers commonly use two poles, one held by each hand, and hikers frequently use one or two walking or trekking poles. Additionally, persons with impaired balance use support poles to help them walk or balance as they walk. Typically, these support poles include hiking poles, crutches, canes, or other such similar devices.

SUMMARY

In one aspect a handheld device is disclosed that includes a pole comprising a curved or a bowed shape. The pole is structured and configured to aid persons in motion under their own power. The disclosed pole can comprise two or more sections that have substantially different shapes. In some embodiments, the disclosed pole can include two or more sections. At least two of the sections are not congruent. In some embodiments at least two of the sections comprise a curvature but are not substantially coplanar.

In another aspect, a handheld device is disclosed that can include a pole comprising a curved or a bowed shape. The disclosed pole can be structured and configured to aid persons in motion under their own power. The pole can include an inverted middle section or a lesser-curved middle section.

In another aspect, a handheld device is disclosed that includes a pole having a curved or a bowed shape. The disclosed pole can be structured and configured to aid persons in motion under their own power. The pole can include a top portion and a bottom portion and the pole can include either a paddle or a ski shoe attached to its bottom portion, or a cross-handle attached to its top portion or a combination thereof.

In this application,

- the term "cross handle" refers to a projection attached to a disclosed pole, usually at the top portion, that is not aligned with the top portion and forms a stop or limit for a hand grip so that the hand does not slide down the top portion.
- the term "hook foot" refers to an element that has an adjustable hook mounted onto the lower portion of a disclosed pole;
- the terms "section" and "portion" are used interchangeably;
- the term "ski shoe" refers to a foot portion that includes a ski element; and
- the terms "user" and "person" are used interchangeably;

DETAILED DESCRIPTION

Figure 1:
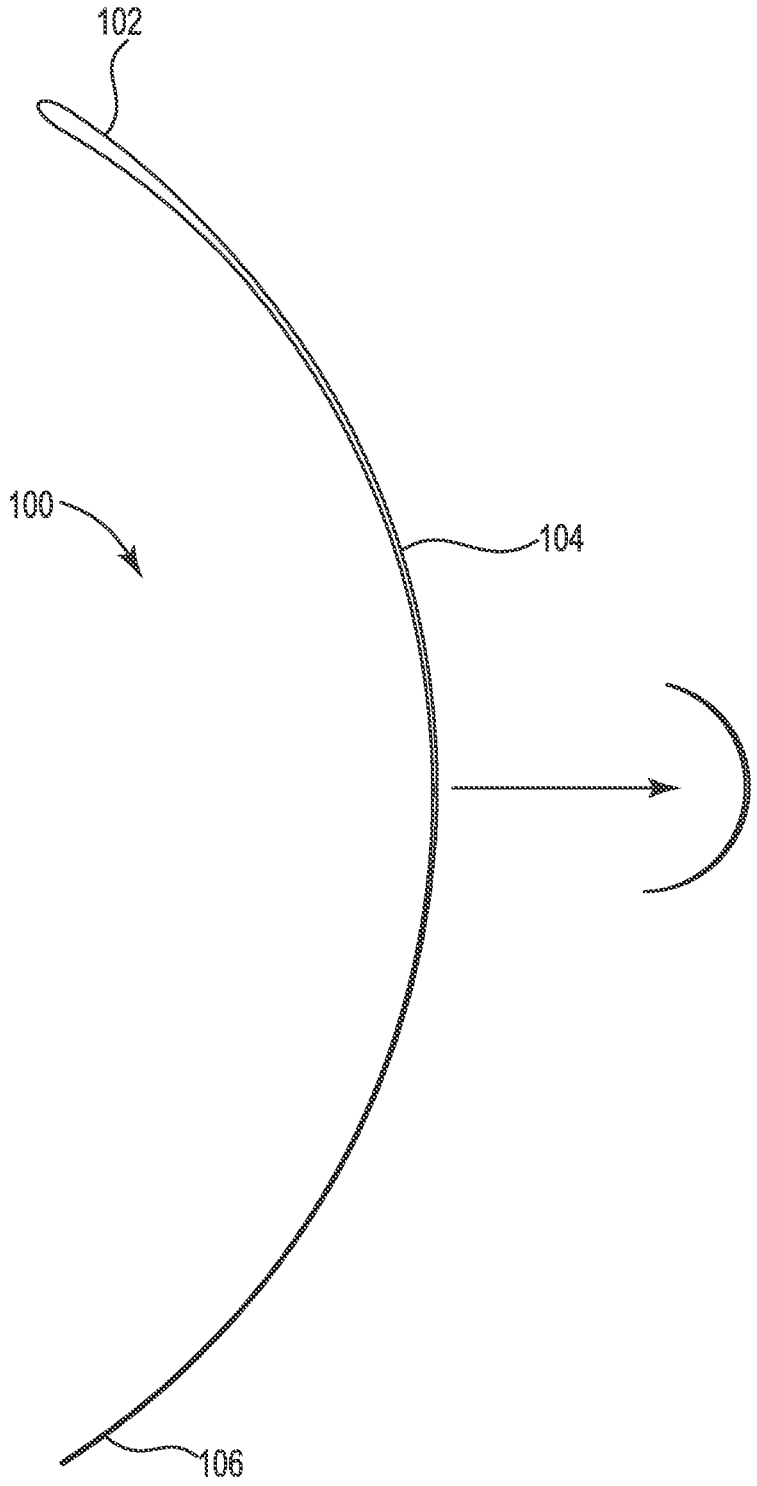
FIG. 1 is a side view of an embodiment of a disclosed bowed pole.

This disclosure relates to devices for aiding persons in motion under their own power, and more particularly, to handheld poles for supporting and propelling said persons. Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements, and those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

The present disclosure describes improved designs for poles that can be used, without limitation, by walkers, hikers, runners, trail-runners, and skiers. FIGS. 1-9 illustrate various possible aspects and features of poles of the present disclosure, but FIGS. 1-9 should not be considered to be limiting, and poles of the present disclosure are not necessarily limited to illustrations and written descriptions of FIGS. 1-9. The following written description can be read with cross-reference to FIGS. 1-9.

FIGS. 1-4 are exemplary illustrations of embodiments of the disclosed bowed pole as a whole. FIG. 1 is a side view of an embodiment of a disclosed bowed pole. Bowed pole 100 can have a bowed or curved shape that generally conforms to an arc that can be a portion of a circle. Disclosed bowed poles can be mechanically resilient and can behave substantially as a spring. In a first unloaded or uncompressed state, the disclosed pole can subtend substantially about one-third of a circumference of a circle. In this first state, the disclosed bowed pole can correspond to a configuration of the pole when a user's hand/arm is at its highest point in a walking/running/skiing/et. motion. The disclosed bowed pole illustrated in FIG. 1 includes top portion 102, middle portion 104 and bottom portion 106. Top portion 102 can include a handle, a grip or other feature that can be grabbed, gripped, or grasped substantially anywhere upon its upper or top portion. In this first state, the disclosed pole may have a height approximately the same as that of the height of a user, or the height of the user's head above the ground.

Figure 2:
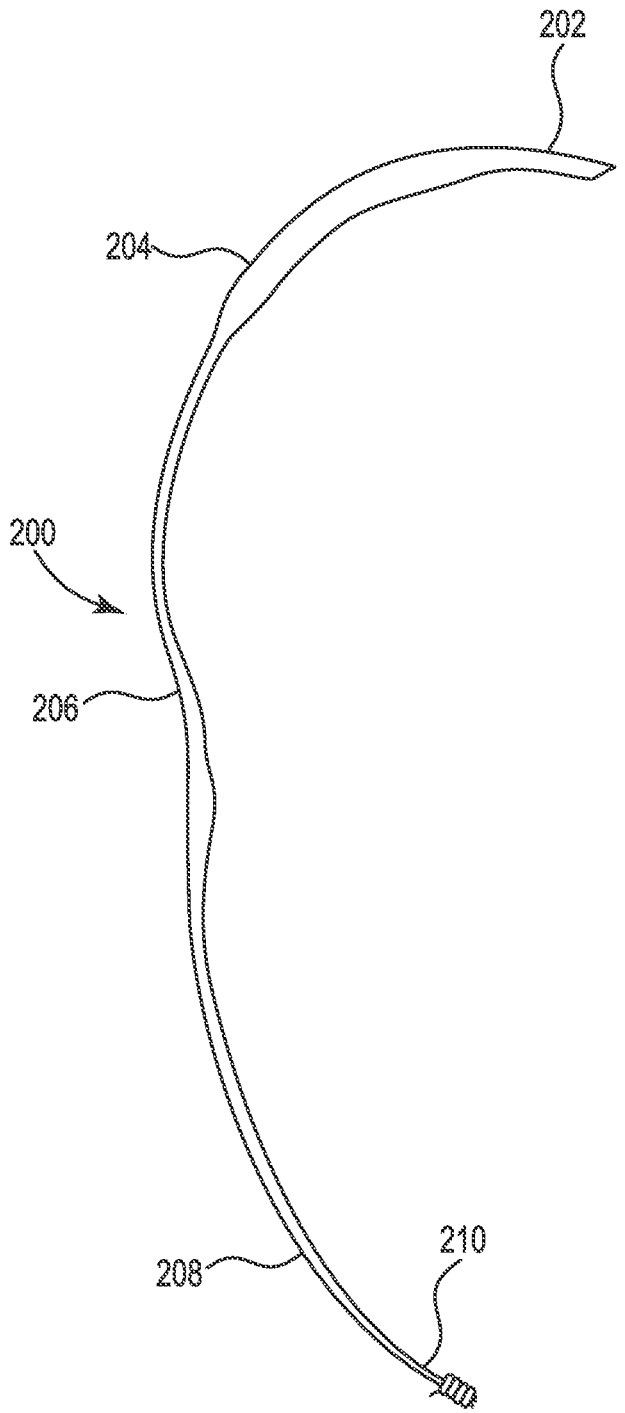
FIG. 2 is a side view of another embodiment of a disclosed bowed pole that includes an inverted middle section.

Middle portion 104 can have many configurations, some of which are additionally described below in reference to FIGS. 2-4. Bottom (or foot) portion 106 can also include tapered, spiked or rubberized features for stability of the pole while in use.

The middle portion 104 can be curved in the opposite direction of arc, as compared to the top and bottom portions. The top section can be flat, indented, have a ridge, or round in order to accommodate a human hand's grip or addition of an accessory hand grip, wrap, or collar. For each portion or section, the degree of curvature of that section can vary depending on materials used, amount of flex desired for particular purpose, or overall length customized to user height or user preference. Any section can be made of a different material than any other section. Such a material can include wood, laminate, carbon fiber, fiberglass, or metal.

The spring action of the disclosed poles can provide benefits for users. As compared with more rigid poles, the disclosed poles can still aid a user's stability while impacting the body more gently. The disclosed poles can flex to different distances between handle and foot permitting a user's body, particularly their arms and upper body, to follow a more varied range-of-motion while walking/running/skiing/etc., as compared with the more restricted pattern(s) of motion that a user's body might be constrained to with conventional rigid poles. Energy stored in the disclosed pole when flexing the disclosed pole as a spring can be returned to the user, to the benefit of the user's motion, when the disclosed pole is un-flexed later in the user's motion. This can allow for a gentler way for users to use their arms to augment their forward motion.

In a second loaded or compressed state, the disclosed pole (shown in one embodiment in FIG. 1) can bend into a tighter curvature with a smaller radius and can thereby subtend a substantially greater portion of a circumference of a circle (of the smaller radius), such as one-half of a circumference (shown by the arrow in FIG. 1). This second state can correspond to points in a user's stride when the hand/arm is at a lower or lowest point.

The disclosed pole can have a variety of shapes within the general description of a curved bow. Any curve in the disclosed bowed pole may be radially consistent or inconsistent with the others describing, in some cases, the arc of a perfect circle while in other cases, an arc of tightening or loosening spiral sections of the curve may also deviate from the planar. Two illustrative examples are shown in FIGS. 2 and 3. FIG. 2 shows embodiment 200 of a disclosed bowed pole that has top portion 204 that includes grip 202. Bowed pole 200 also includes bottom section 208 that includes a foot feature 210 for stability. Middle section 206 of the disclosed bowed pole illustrated in FIG. 2 may have an inverted middle section 206 (curvature opposite of the general curve of pole 200 as a whole).

Figure 3:
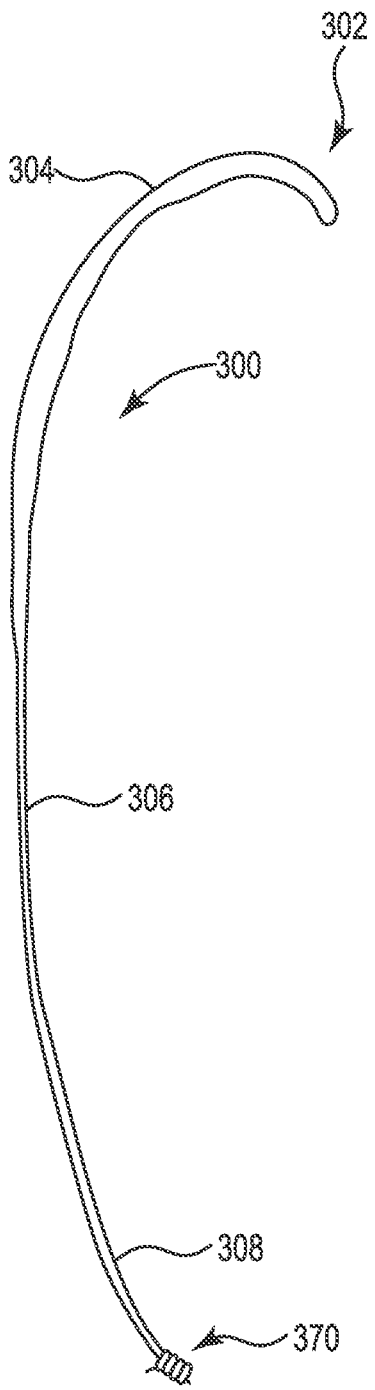
FIG. 3 is a side view of another embodiment of a disclosed bowed pole that includes a lesser-curved middle section.

Alternatively, as shown in FIG. 3, the disclosed bowed pole may be curved at its top and bottom while having a straight or lesser-curved middle section, as illustrated in FIG. 3. FIG. 3 shows bowed pole 300 that includes top section 304, bottom section 308 (including foot feature 310). Bowed pole 300 has a lesser-curved middle section 306 than the embodiment illustrated in FIG. 2. Further, any curve may be radially consistent or inconsistent with the other curves. Therefore, in some cases, the curvature may have the arc of a perfect circle, as illustrated in FIG. 1, while in other cases the arc may be of a tightening or loosening spiral. Sections of the disclosed pole may also deviate from the planar. In some embodiments, the middle portion of the bowed pole can be curved in an opposite curvature direction compared to that of the top and bottom sections, as illustrated in FIG. 2 wherein the middle section has an inverted curvature. In each section, the degree of curvature can vary depending on materials used, amount of flex desired for particular purpose, or overall length customized to user height and/or user preference.

Figure 4:
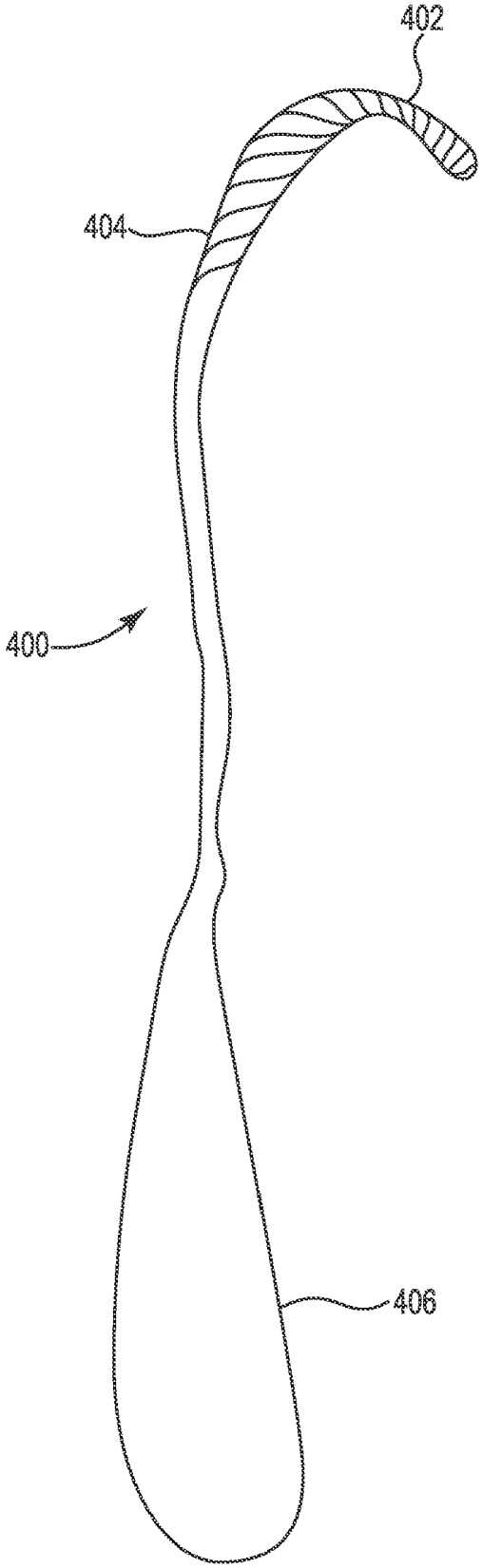
FIG. 4 is a perspective view of yet another embodiment of part of a disclosed bowed pole that includes a paddle.

FIG. 4 is an illustration of an embodiment 400 having top section 404 that includes grip 402 and a bottom section that includes a paddle 406. This embodiment can act as a flexible paddle for a canoe, kayak, or other small watercraft.

Figure 5:
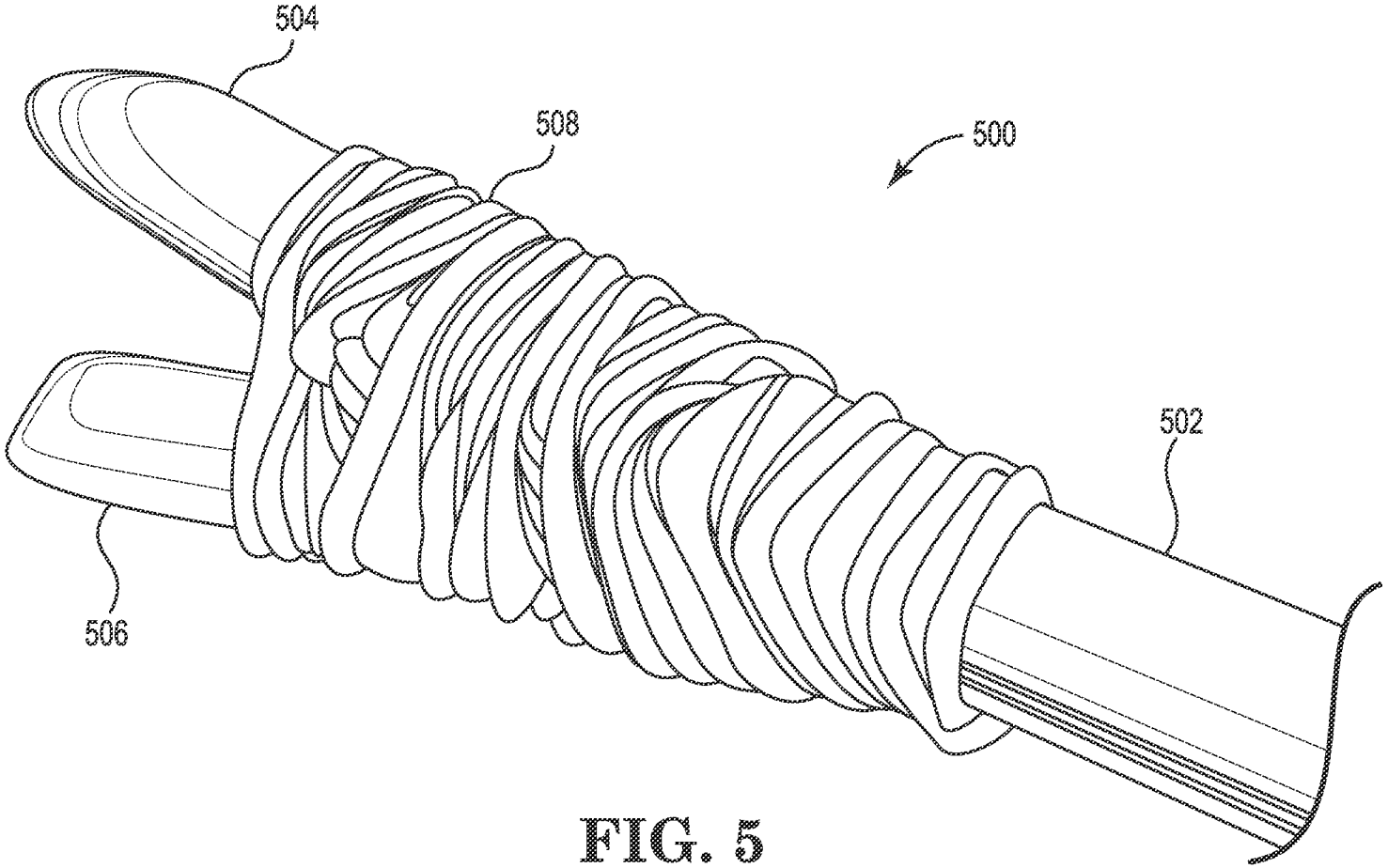
FIG. 5 is a perspective view of an embodiment of a part of a disclosed bowed pole that includes an angled recursive foot.

FIG. 5 is a perspective view of an embodiment of a part of a disclosed bowed pole that includes an angled recursive foot. Angled recursive foot 500 can be located at the bottom portion of a disclosed bowed pole as shown in the illustration. Angled recursive foot 500 includes recursive foot 506 attached at an angle to bottom portion 502 of the disclosed bowed pole. Recursive foot 506 can be attached using any type of binding, glue, mechanical fastener, or other device such as those mentioned elsewhere in this disclosure to attach accessories to the disclosed pole.

Figure 6:
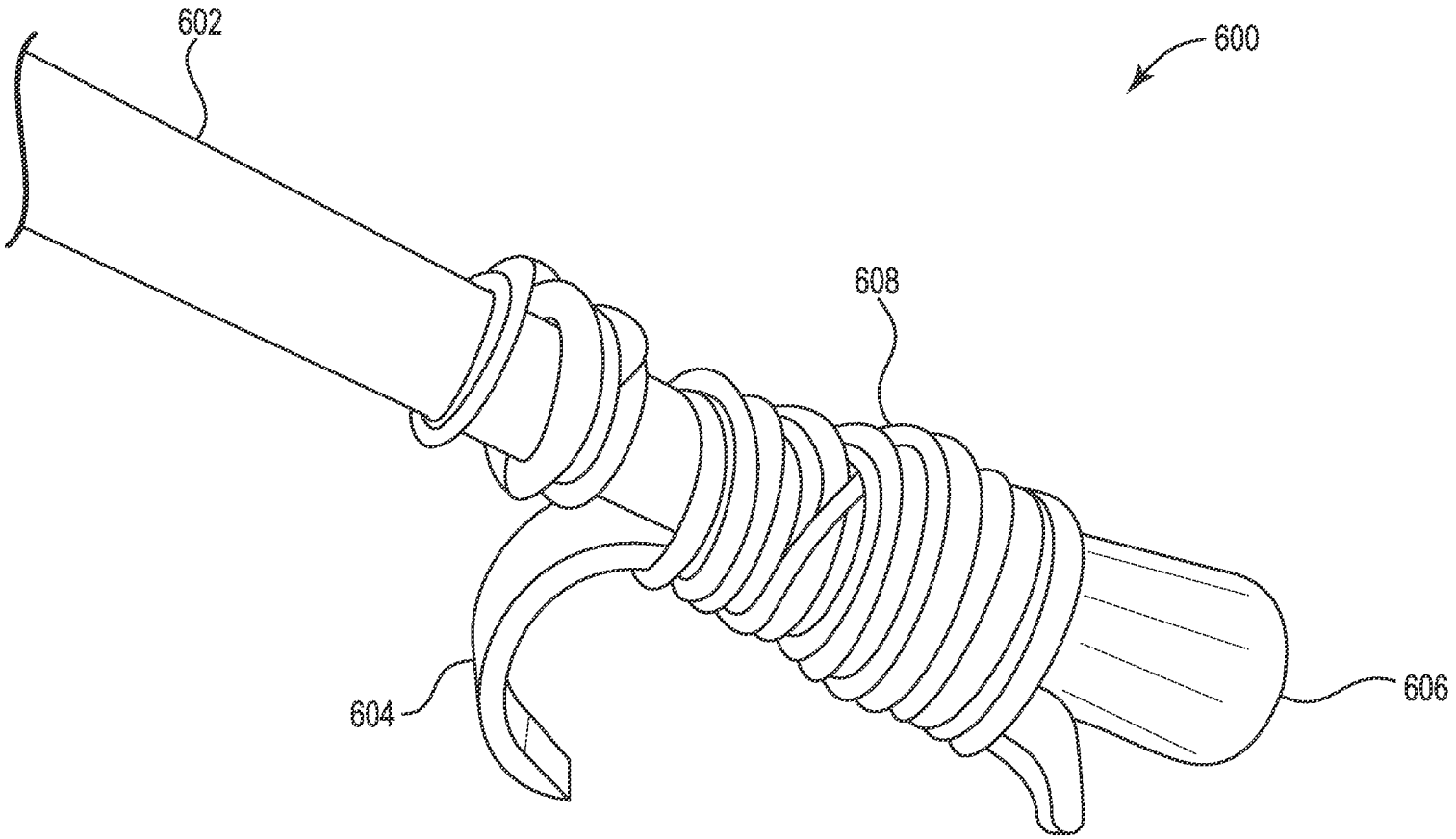
FIG. 6 is a perspective view of an embodiment of a part of a disclosed bowed pole that includes an adjustable hook foot.

FIG. 6 is a perspective view of an embodiment of a part of a disclosed bowed pole that includes an adjustable hook foot attached to the bottom of the pole. Bowed pole 600 has a hook foot 604 attached to bottom section 602 of bowed pole 600. Hook foot 604, in the illustrated embodiment, is moveable up and down bottom section 602 using adjustable strap 608. In this embodiment, removeable rubber tip 606 is shown on the end of bottom section 602 of the illustrated bowed pole. Hook foot 604 can allow for a firm connection with the ground when the user is descending a slope or when the disclosed pole is extended in front of the user while walking/exercising. The front end of the hook foot may be shaped in a variety of ways. For example, the hook foot may be shaped like the hoof of a deer. Additionally, the hook foot may have spikes useful for gripping. In other embodiments, the hook foot maybe shaped like a mini bow. It can also be V-shaped.

Figure 7:
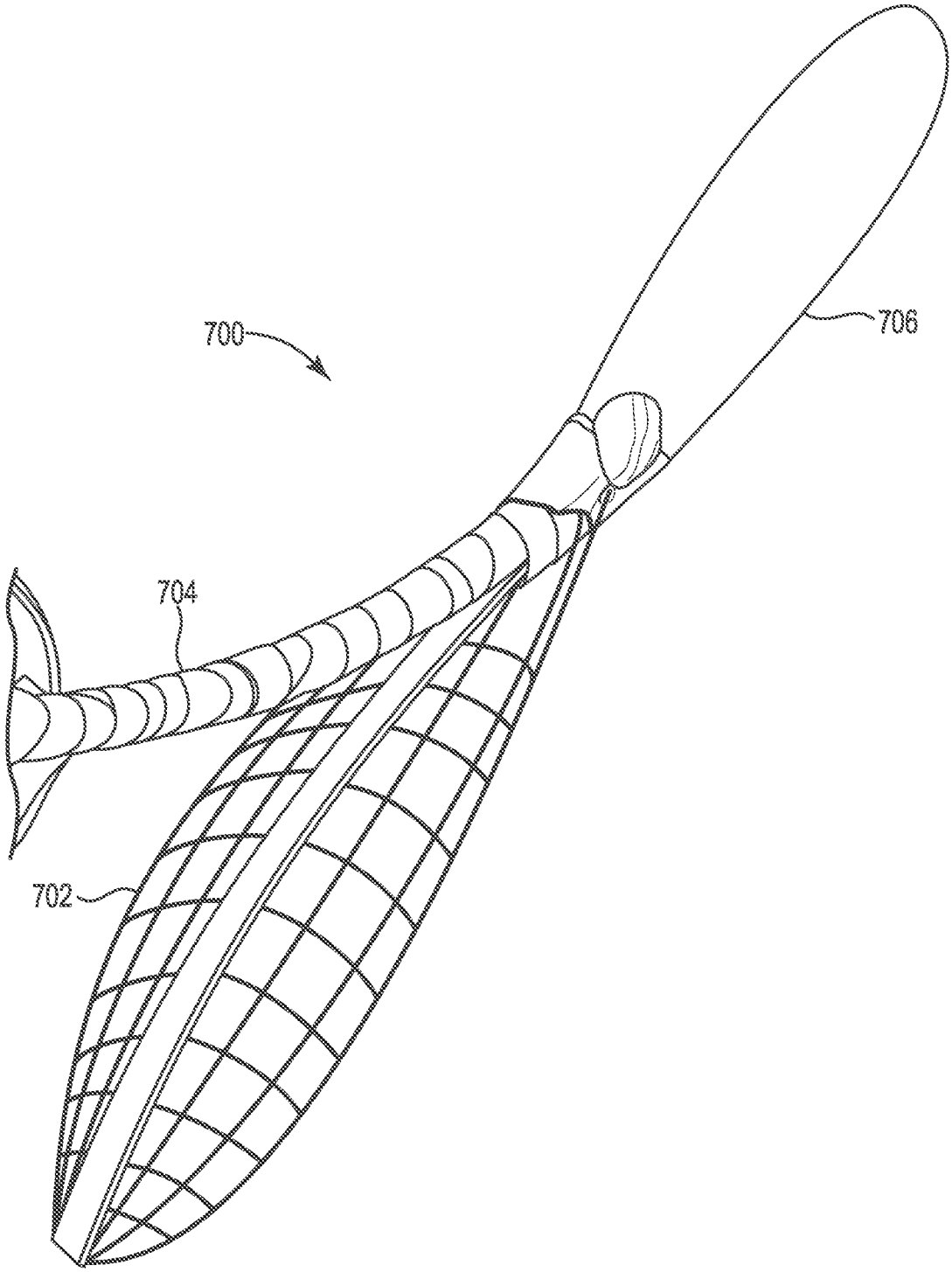
FIG. 7 is a perspective view of an embodiment of a part of a disclosed bowed pole that includes a ski shoe.

FIG. 7 is a perspective view of an embodiment of a part of a disclosed bowed pole that includes a ski shoe attached to the bottom section of the pole. For this embodiment, bowed pole 700 includes a lower portion 704 that includes a ski shoe as the foot portion. This type of pole is useful on slippery surfaces such as snow and ice. The ski shoe illustrated in FIG. 7 can include ski 706 for sliding and traction portion 702 which can act as a snowshoe. Traction portion 702 can give the disclosed bowed pole the ability maneuver on snow like a snowshoe. It is contemplated that bowed pole 700 can include either ski 706 or traction portion 702 or both. When fully engaged, the tip of the bow can connect firmly with the ground, planting the pole like a ski pole. The end tip of the disclosed pole may incorporate recurve design that may be rigid or flexible according to that preferences of a user and/or the desired action of the disclosed pole. The end section of ski shoe 706 may include flexible tips shaped to accentuate a gradual onset of resistance.

Figure 8:
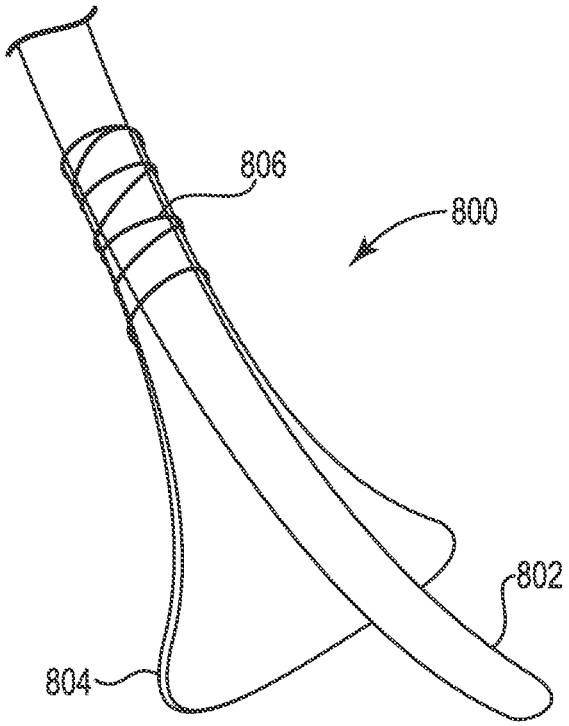
FIG. 8 is a perspective view of an embodiment of a part of a disclosed bowed pole that includes a powder hip attached to the bottom section of the pole.

FIG. 8 is a perspective view of an embodiment of a part of a disclosed bowed pole that includes a powder hip. Lower portion 800 of the disclosed pole has tip 802 that can be used in powdered snow to make a firm placement of the disclosed pole in the snow. Powder hip 804 can be attached to shaft 806 of lower portion 800 by any binder used for other accessories that are described herein. Powder hip 804 is made of flexible material such as rubber, plastic, or flexible wood and can bend and engage powdered snow so as to allow tip 802 to glide forward before it makes firm placement in the snow.

Figure 9:
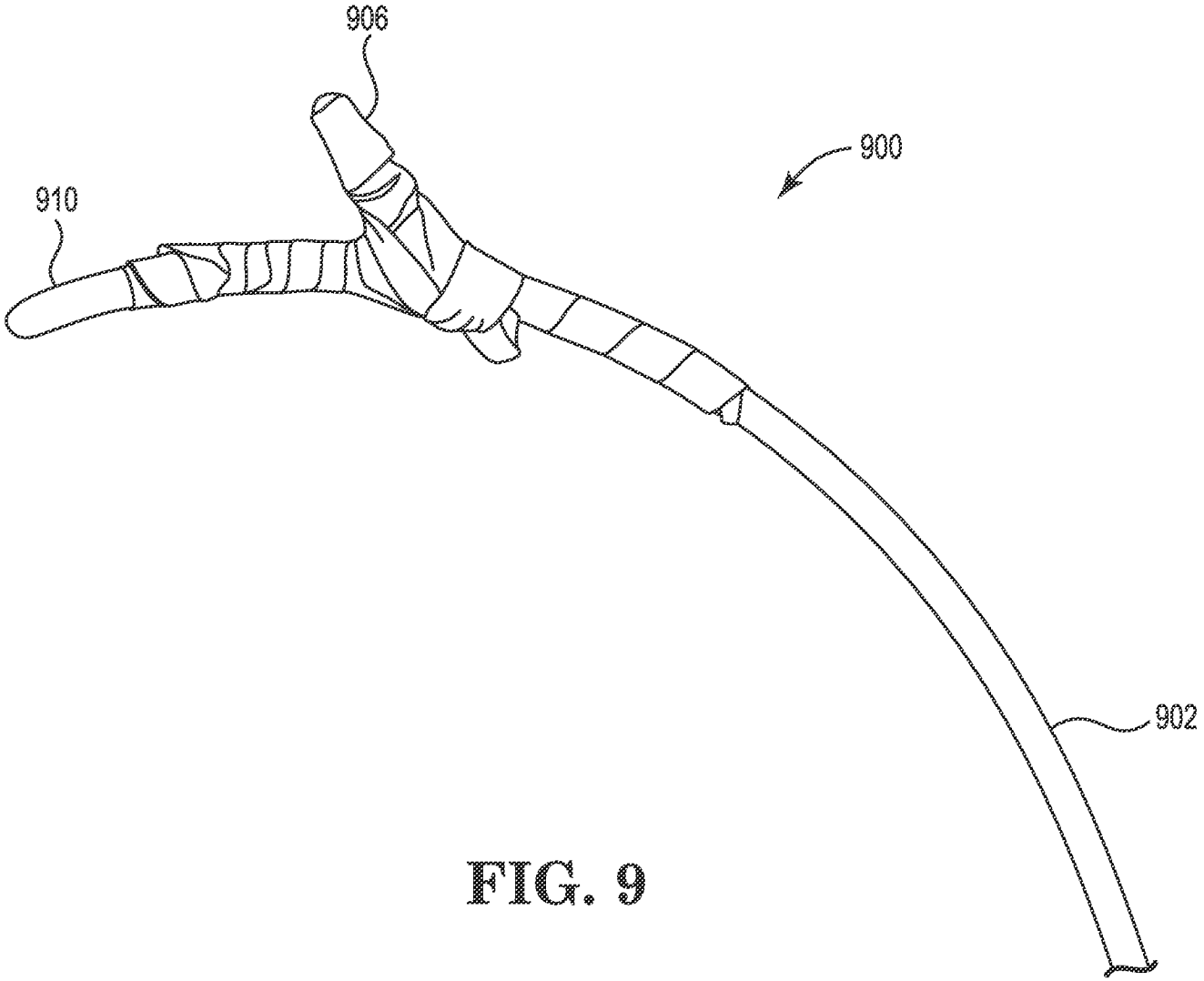
FIG. 9 is side view of an embodiment of a part of a disclosed pole that includes a cross handle on the top section of the pole.

FIG. 9 is a side view of an embodiment of a part of disclosed pole 900 that shows to portion 902 of pole 900 that has cross handle 906 attached thereto. Cross handle 906 can be an accessory to the disclosed pole. The cross handle can function as a hand grip and can encourage proper alignment of the disclosed pole for rhythmic action and for repositioning after each stride. Cross handle 906 can also function as a fastener that can connect two of the disclosed poles together. In this configuration, the two fastened polls can be used as a standing chair and with various strength training and stretching exercises. In some embodiments, a strap maybe incorporated into the design. The strap may support the wrist or elbow of the user and additionally may act as a fastener when connecting the two poles together. Possible materials that can be used to make the cross handle maybe, but are not limited to, carbon fiber, fiberglass, wood, leather, sinew, synthetic sinew, twine, plastic, rubber, or canvas.

Multiple sizes of poles can be provided such that users can select poles matching their heights. In some embodiments, the disclosed poles may be modular. For example, the disclosed poles can be structured and configured to be taken apart into two or more sections enabling the disclosed poles to change their height. Such modular poles may allow a user to switch out sections of the disclosed pole and replace them with other sections. The modular poles may also allow a user to more easily store or carry the disclosed poles. In some embodiments, any section of any of the one of the disclosed poles, or the disclosed pole as a whole, may be telescopic to allow for height or grip adjustment. Poles can fit together manually by inserting, screwing, locking, fitting, or affixing by use of a collar, wrap, tie, or another component.

Poles of the present disclosure can be manufactured of any suitable materials, in any suitable configuration, and by any appropriate methods. They can be manufactured of, without limitation, wood (in some cases, in a laminated construction), carbon fiber, fiberglass, graphite, and/or polymers. Furthermore, if there is more than one section, the sections can be comprised of the same or different materials.

In some cases, poles can be manufactured with round cross-sections. In some other cases, poles can be manufactured with rectangular cross-sections, or another non-round cross-section, which can contribute to different flexure properties (e.g., spring constants) in different planes. For example, a pole can be manufactured to be more flexible (lower spring constant) in the plane of curvature of the bowing of the disclosed pole, while it can be substantially stiffer (higher spring constant) perpendicular to that plane.

The top section of a modular pole (for example, near a top end of the bowed pole) can flatten, indent, ridge, or round to accommodate a human hand's grip, or addition of an accessory hand grip, wrap, or collar may be added to the top section. In some cases, the disclosed pole can include a handle structured and configured for a user to grip. In other cases, the disclosed pole can be grabbed, gripped, or grasped substantially anywhere along its upper length. The handle can have any appropriate shape. In some cases, the handle can be a round portion of the disclosed pole and can be approximately two inches in diameter. In some cases, the handle can have a shape that is specifically molded to improve grip-ability by a hand. In some cases, the disclosed pole can include an attached wrist strap, which can be selectively detachable or can be permanently attached to the disclosed pole.

The disclosed pole can include, at a bottom section a foot portion that is structured and configured for contact with the ground. The bottom section (foot portion) can be structured and configured to provide stability with ground contact. In various cases, the foot portion can be (without limitation) tapered, spiked, clubbed, and/or rubberized, or any combination of these configurations.

Any section (for example, top, middle, or bottom) of the disclosed pole may come to an end that is blunt, sharp, bulbous, flattened, or hooked by varying degrees. The bottom end of the disclosed pole may additionally be footed, tooled, pronged, or wrapped to support traction, stability, balance or positioning. The bottom end of the disclosed pole may be integral to the disclosed pole materials or affixed as a separate accessory using different materials such as leather, rubber, fiberglass, bone, or metal.

Accessories are contemplated that can affix, bind, tether, or connect two or more poles to one another for a variety of uses. For example, two or more poles can be connected together to create a seat, stretcher, bivouac, sledge, or fishing weir. More specifically, combined poles can thus be used as standing chairs in, for example, an office, as cots on emergency sites, or any number of uses in various environments. Furthermore, combined poles can be used as backpack props while a wearer is standing with a shouldered backpack. Connection components that can be used for backpacks, compatible seats, nets, or tenting can include loops, snags, tie-downs, or other fastening mechanisms, and poles can accessorize to respond as needed with any combination of holes, clips, notches, anchor points, and/or fasteners.

In some embodiments, the disclosed poles can be used during exercises to strengthen and stretch muscles and improve balance. The shape and structure of the disclosed poles can allow for a variety of resistance training. Therefore, in addition to their intuitive use for walking and hiking, the disclosed poles can be used by fitness, yoga, and Pilates practitioners to enhance workouts.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

What is claimed is:

1. A handheld device comprising:

a pole comprising a curved or a bowed shape, wherein the pole is structured and configured to aid persons in motion under their own power, the pole includes a top section, a middle section, and a bottom section, the middle section is centrally spaced within a central third of a length of the pole, each of the top, middle, and bottom sections are flexible, the top, middle, and bottom sections comprise curvature, the pole conforms to an arc when in a compressed state; and further comprising a powder hip, wherein the powder hip removably attaches to the bottom section, is positioned behind the bottom section such that there is space between the powder hip and a tip of the pole, has a wide front face, and is comprised of rubber, plastic, flexible wood, and combinations thereof.

2. The handheld device of claim 1, wherein the pole subtends at least one-third of a circumference of a circle.

3. The handheld device according to claim 2, wherein the pole subtends about one-third of a circumference of a circle.

4. The handheld device according to claim 3, wherein the pole subtends between one-third and one-half of a circumference of a circle.

5. The handheld device according to claim 1, wherein the top section and the bottom section of the pole comprise curvature along their entire lengths.

6. The handheld device according to claim 1, wherein the middle section of the pole comprises curvature along its entire length.

7. The handheld device according to claim 1, wherein the entirety of the pole has curvature.

8. The handheld device according to claim 1, further comprising a grip.

9. The handheld device according to claim 1, further comprising a cross handle removably attached to the top section and angled at less than 90 degrees with respect to the top section, wherein the cross handle intersects the top section such that a portion of the top section is above the cross handle and the remainder of the top section is below the cross handle.

10. The handheld device according to claim 1, wherein the bottom section comprises a paddle, an angled recursive foot, an adjustable hook foot, or a ski shoe.

11. The handheld device according to claim 1, wherein the pole is configured to flex between at least the compressed state and an uncompressed state, the pole has a first partial circumference and a first radius in the uncompressed state, the pole has a second partial circumference and a second radius in the compressed state, the second partial circumference is greater than the first partial circumference, and the second radius is smaller than the first radius.

12. The handheld device according to claim 11, wherein energy is stored in the pole when the pole is in the compressed state, and the stored energy is returned as a spring when the pole transitions from the compressed state to the uncompressed state.

13. The handheld device according to claim 1, wherein the top section, middle section, and bottom section define the entire length of the pole.

* * * * *